United States Patent [19]

Ichise et al.

[11] 4,203,860

[45] May 20, 1980

[54] NITROGEN-EMITTING COMPOSITION TO BE USED WITH FLASH GETTER MATERIALS

[75] Inventors: Wataru Ichise, Tokyo; Yasuo Kinjo, Yokohama; Kenji Enokida; Hideharu Nihei, both of Kawasaki, all of Japan

[73] Assignee: Tokyo Shibaura Electric Co., Ltd., Kawasaki, Japan

[21] Appl. No.: 574,419

[22] Filed: May 5, 1975

Related U.S. Application Data

[60] Division of Ser. No. 355,345, Apr. 30, 1973, abandoned, which is a continuation-in-part of Ser. No. 179,057, Sep. 9, 1971, abandoned.

[30] Foreign Application Priority Data

Sep. 10, 1970 [JP] Japan ..... 45-78878

[51] Int. Cl.[2] ..... H01J 7/20

[52] U.S. Cl. ..... 252/181.2; 252/181.6; 316/3

[58] Field of Search ..... 252/181.2, 181.4, 181.6, 252/181.7; 313/174; 316/3, 25

[56] References Cited

U.S. PATENT DOCUMENTS 3,389,288 6/1968 Della Porta et al. ..... 252/181.7

OTHER PUBLICATIONS

Ryklis et al., "Chem. Abstracts", vol. 69, 1968, p. 22233e.

*Primary Examiner*—Jack Cooper

*Attorney, Agent, or Firm*—Frishauf, Holtz, Goodman & Woodward

[57] ABSTRACT

A nitrogen-emitting composition which is adapted to be used with flash getter materials. Said composition comprising iron, germanium, and nitrogen. These materials are used within cathode ray tubes to produce a getter film which is deposited on the inner walls of the cathode ray tube.

1 Claim, 5 Drawing Figures

Figure 4:
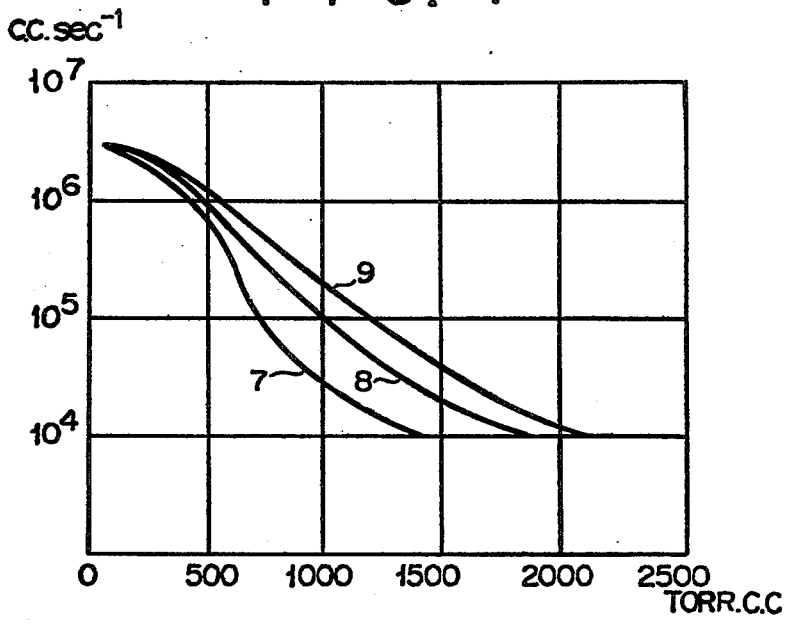

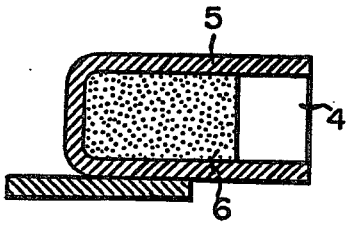
FIG. 1
FIG. 2
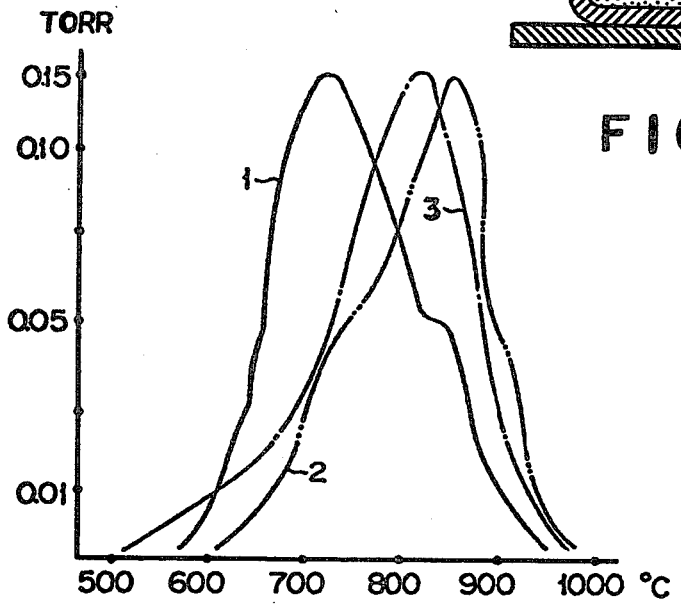
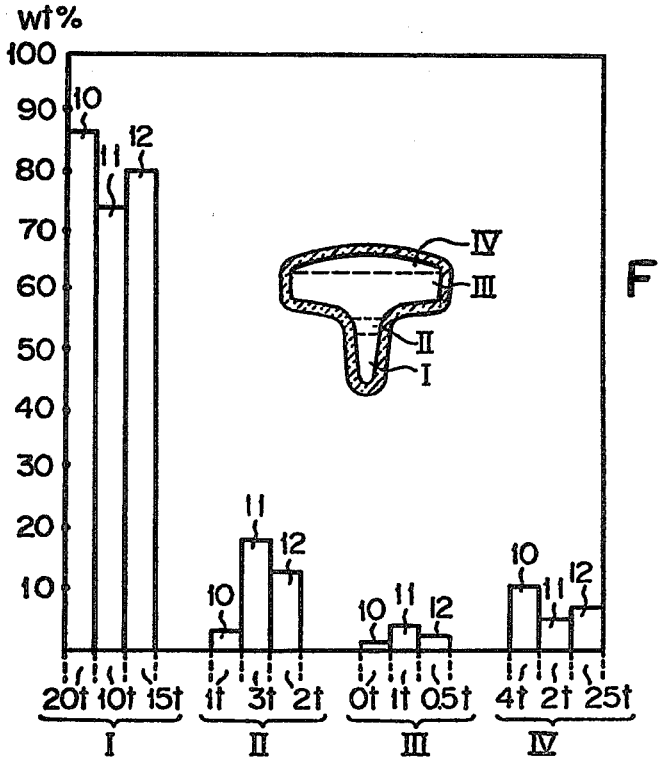
FIG. 3

NITROGEN-EMITTING COMPOSITION TO BE USED WITH FLASH GETTER MATERIALS

This application is a divisional application of Ser. No. 355,345 filed on Apr. 30, 1973 now abandoned which in turn was a continuation in part application of Ser. No. 179,057 filed on Sept. 9, 1971 and now abandoned.

This invention relates to a getter composition and more particularly to a flash getter composition for cathode ray tubes.

In the manufacture of a general electron tube, there is deposited a getter film of, for example, barium on the inner walls of the tube to eliminate, after evacuation, residual gases still remaining therein and to preserve a desired state of vacuum within the tube as long as it is used. When there is flashed a getter material to obtain the deposit of a getter film, said material is evaporated toward the inner walls of the tube in such a manner that the vapours of said material do not settle on the undesired parts of the tube, for example, the screen and electron guns of a television picture tube.

Where there is deposited a getter film on the inner walls of a cathode ray tube, the customary measures taken to prevent the brightness of images from being reduced due to the attachment of getter vapours to the fluorescent surface of the tube consist in, for example, fitting a getter vessel containing a getter composition to the ends of the tube electrodes, facing the evaporating surface of the getter material toward the other portions of the tube walls than the fluorescent surface, or providing an adequate shield on that side of the getter vessel which faces the fluorescent surface of the tube so as to mechanically impart a proper directionality to the passage of getter vapours, that is, to diffract said passage.

The cathode ray tube for a television set (hereinafter referred to as a "C.R.T." is formed of a face portion, cone portion and neck portion. However, with a C.R.T. having a large deflection angle or a narrow neck portion, the aforementioned measures present difficulties in preventing the deposition of getter vapours on the fluorescent surface due to the linear passage of said vapours. Particularly for a colour C.R.T., which includes an increased number of electrodes with the resultant containment of large amounts of residual gases, it is desired to deposit a getter film on the internal surface of the cone portion alone without allowing it to settle on the face portion in order to avoid the decreased brightness of images produced on said face portion due to the undesirable settlement of the getter film.

To meet this requirement, there has been proposed a gas doped getter composition. According to this method, the vapours of a getter material, for example, barium vapours evolved from the barium material contained in the gas doped getter composition is made to impinge on the gases, for example, nitrogen released from the gas dope included in said composition, thereby diffracting the passage of the barium vapours to prevent them from settling on the fluorescent surface of a C.R.T. In this case, the vapours of barium are reduced in energy and attach themselves to the inner walls of the tube under the condition in which the intermolecular bonding force of barium is weakened, thus resulting in the formation of a porous getter film. Dispersion of the barium vapours resulting from collision with nitrogen gas enables the barium to be deposited on the inner walls of the tube in increased areas with a greater gas adsorbing capacity due to the porosity of the barium film thus deposited.

Heretofore known is a gas doped getter composition prepared from a mixture of iron nitride ($Fe_4N$) evolving nitrogen gas upon thermal decomposition and commonly used flash getter materials including, for example, barium, said composition being packed under pressure into a getter vessel.

However, the above-mentioned gas doped getter composition has the drawback that the iron nitride is most likely to decompose itself at relatively low temperatures at which the entire tube is heated during the evacuating or baking step, and consequently the nitrogen gas thus released is simply wasted before it can be used in collision with barium vapours. This means that the nitrogen gas generated from the iron nitride can diffract the passage of barium vapours for too short a period due to its specific decomposition characteristics. It should be further noted that since the aforesaid gas doped getter composition is intended to diffract the passage of barium vapours by collision with the nitrogen gas evolved by the decomposition of the iron nitride, it is necessary to have sufficient amounts of nitrogen gas generated prior to the evaporation of barium. As mentioned above, however, part of the iron nitride is already decomposed during the baking step which is generally conducted at temperatures of 450° to 500° C. (see FIG. 1). Accordingly, the prior art gas doped getter composition sometimes fails to display a desired effect when there is flashed a getter material. Further, the iron nitride is rapidly decomposed at the same time barium commences evaporation (at about 800° C.). This presents difficulties in controlling the direction in which there are scattered the vapours of barium and consequently in realizing the formation of a porous film of barium. Since it is preferred that a getter material be flashed slowly, it is practically difficult to limit the time of said flash to within the period during which the iron nitride completes its decomposition. Thus viewed, the aforesaid conventional gas doped getter composition has a significant defect in that it can diffract the passage of barium vapours for too short a period.

It is accordingly the object of this invention to provide a flash getter composition for cathode ray tubes prepared from a mixture of a flash getter material and gas dope compound, which remains thermally stable while the cathode ray tube is baked and can impart a diffraction effect to the vapours of a getter material for a relatively long period.

A flash getter composition according to this invention is prepared from a mixture of a flash getter material and a ternary gas dope compound formed of iron, germanium and nitrogen.

The ternary gas dope compound according to this invention may consist of $Fe_2Ge$ nitride including proper amounts of $FeGe_2$ nitride or $Fe_2Ge$ nitride alone. These nitrides consist of $Fe_4GeN$ and $\beta$-$Ge_3N_4$. $Fe_2Ge$ nitride mainly consists of $Fe_4GeN$ with minor amounts of $\beta$-$Ge_3N_4$, while $FeGe_2$ nitride mainly consists of $\beta$-$Ge_3N_4$ with minor amounts of $Fe_4GeN$. Preparation of these nitrides may be effected first by alloying iron and germanium followed by pulverization and then thermally nitrogenizing the resultant powders in an atmosphere of, for example, ammonia gas. X-ray diffraction analysis shows that the nitride thus prepared consists of a concomitant formation of nitrides of iron and germanium and those of germanium. Thus flash getter material used in this invention may consist of an alloy of barium and aluminium including small amounts of nickel powders.

A mixture of the aforesaid ternary compound and flash getter material is charged under pressure into a conductive vessel open at one end.

The conductive vessel containing said getter composition is fixed, for example, to that end of an electron gun received in the neck portion of a C.R.T. which is adjacent to the face portion. When fully assembled, the C.R.T. is baked with the getter composition thus charged. After the tube is sealed, the mass is particularly heated by an induction heater to release nitrogen gas and the vapours of the getter material contained in said composition through the opening of the getter vessel in the prescribed direction. Collision of the getter vapour with the nitrogen gas causes the former to be deposited in the form of a porous film at the desired parts of the inner walls of the C.R.T.

The ternary gas dope compound consisting of iron, germanium and nitrogen, which is included in the flash getter composition of this invention is stable to the heat used in baking the tube and enables a proper degree of nitrogen gas pressure to prevail in the tube while the getter material is flashed, thereby imparting a good diffraction effect to the getter vapours, and permitting the formation of a getter film having a prominent capacity to adsorb gasses.

Figure 5:
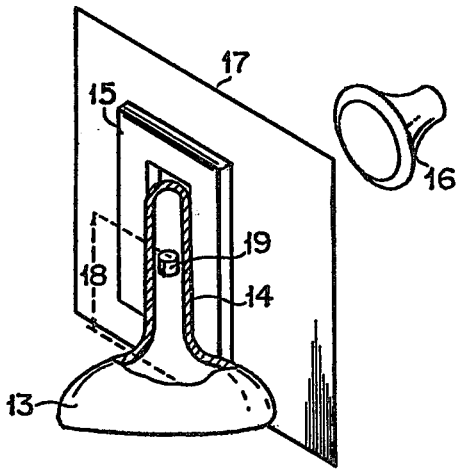

This invention can be more fully understood from the following detailed description when taken in conjunction with reference to the accompanying drawings, in which:

FIG. 1 is a sectional view of a flash getter composition according to an embodiment of this invention where it is charged into a getter vessel;

FIG. 2 compares the decomposition characteristics of a ternary gas dope compound consisting of iron, germanium and nitrogen according to this invention and those of the known gas dope compound formed of iron nitride;

FIG. 3 compares the distribution of barium and the thickness of its film in the C.R.T.'s respectively using a non-gas doped getter composition, a getter composition including a gas dope consisting of a ternary compound of iron, germanium and nitrogen and a getter composition containing a gas dope of iron nitride;

FIG. 4 compares the gas adsorbing capacity of a film of barium formed on the inner walls of the C.R.T.'s using gas doped getter compositions including different gas dope compounds; and FIG. 5 illustrates the manner in which there is photographed a back flash condition occurring when there is flashed getter material contained in a variety of getter compositions.

FIG. 2 is a curve diagram of the decomposition characteristics of $Fe_2Ge$ nitride indicated at 1 and $FeGe_2$ nitride indicated at 2 both available as a gas dope compound for this invention and the known gas dope compound of iron nitride indicated at 3. The abscissa represents heating temperature (°C.) and the ordinate the pressure (Torr) of decomposed nitrogen gas. The iron nitride $Fe_4N$ decomposes itself substantially at 500° C. to evolve nitrogen gas which presents a maximum pressure approximately at 800° C., said decomposition being completed almost at 950° C. As previously described, therefore, the iron nitride partly commences decomposition during the baking of a C.R.T. which is conducted at temperatures of 450° to 500° C., most likely failing to attain the object of providing sufficient amounts of nitrogen gas when there is flashed a getter material. The present inventors' experiments show that where the starting time (the time required for a getter material to begin evaporation after initial heating) is taken to be 8 seconds, the barium included in a getter composition containing a gas dope compound of iron nitride commences evaporation when the nitrogen gas evolved in the tube presents a pressure equal to about one third of its maximum level, the iron nitride continues to decompose itself, and the released nitrogen gas attains a maximum pressure about 3 seconds after the initial evaporation of the barium. Namely, since there still prevails a relatively low gas pressure before evaporation of barium, its evolution rapidly takes place several seconds after its initial volatilization. This possibly leads to vigorous collisions between the vapours of barium and the molecules of the released nitrogen gas, causing part of the barium vapours to be scattered toward the electron gun to decrease the pressure strength of the tube. Further in this case, the nitrogen gas does not fully assist the barium vapours to be formed into a good porous getter film, though said gas prominently disperses the barium vapours. The present inventors' experiments further show that the nitrogen gas released after the maximum decomposition of the iron nitride is rapidly adsorbed by the already deposited barium film. The nitrogen gas evolved by the decomposition of the iron nitride ceases to diffract the vapours of barium in about 12 seconds after its initial evaporation. If there is heated the getter composition for longer than 12 seconds, then the aforesaid diffraction effect will disappear, because the gas pressure within the tube is already reduced, most likely allowing barium vapours to be brought to the face portion of the tube and further a fresh plain film of barium to be formed on its already deposited porous formation. Considering the type of tube and the amounts of barium required however, it would be substantially difficult to complete the flashing of a getter material within a period of 12 seconds in order to eliminate the above-mentioned difficulties. As described above, therefore, application in a C.R.T. of a getter composition containing the conventional gas dope compound will result in a failure fully to extend the flashing time of said material and present difficulties in improving the distribution of a film of barium and its capacity to adsorb gases.

According to an embodiment of this invention, a conductive getter vessel 5 having an opening 4 at one end is packed under pressure with a uniform mixture 6 of a gas dope compound of $Fe_2Ge$ nitride, and a getter material of an aluminium-barium alloy containing small amounts of nickel powders. The $Fe_2Ge$ nitride can be prepared by alloying iron and germanium, pulverizing the alloy to powders having an average particle size of less than 35 microns and nitrogenizing said powders in an atmosphere of ammonia at a temperature of about 550° C. As determined by X-ray diffraction analysis, said nitride mainly consists of $Fe_4GeN$ and contains minute amounts of $\beta$-$Ge_3N_4$. The getter composition of FIG. 1 is fixed to the end of an electron gun (not shown) received in a C.R.T. and subjected to high frequency heating after completion of the baking and seal of the tube.

When the getter material contained in the composition of FIG. 1 according to this invention was initially flashed, the pressure of nitrogen gas evolved by decomposition of the $Fe_2Ge$ nitride (see curve 1 of FIG. 2) displayed, as determined by the Pirani gauge, a pressure equal to two-thirds of its maximum level, that is, a far higher pressure than the pressure of the nitrogen gas released from the aforesaid gas dope of $Fe_4N$ before evaporation of barium, the latter pressure only accounting for one-third of its maximum level. The present inventors' experiments further show that nitrogen gas in the tube presented a maximum pressure about 2 seconds after initial evaporation of barium, and the nitrogen gas expelled after said maximum pressure was adsorbed by an already deposited barium film, as when there was flashed a getter material in the composition, containing the gas dope of $Fe_4N$. In the case where there was flashed a getter material in the composition containing the gas dope of $Fe_2Ge$ nitride according to this invention, there occurred the pressure of decomposed nitrogen gas, though to a small extent. This is supposed to originate with the fact that the $Fe_2Ge$ nitride was actually formed of two types of nitride.

Here it should be noted that where there was flashed a getter material in the composition containing the gas dope of $Fe_2Ge$ nitride according to this invention, there was expelled nitrogen gas from said gas dope for a relatively long period before initial evaporation of barium fully to raise a gas pressure in the tube, preventing barium vapours from being rapidly evolved with the resultant vigorous collision with the nitrogen gas, thereby enabling said collision to take place gently over a relatively long period, and that, as described above, there was still observed the presence of released nitrogen gas pressure.

FIG. 4 compares the carbon monoxide adsorbing capacity of a barium film formed in the 16" type C.R.T.'s using getter compositions respectively containing the gas dope of $Fe_2Ge$ nitride according to this invention and the gas dope of $Fe_4N$ according to the prior art. The ordinate represents the rate (c.c. $sec^{-1}$) at which the barium film adsorbed carbon monoxide, and the abscissa denotes the amounts (Torr c.c.) of carbon monoxide adsorbed before there was attained said adsorbing rate. The amount of barium deposited on the inner walls of the tube was 60 mg. The curve 7 represents a barium getter doped with sufficient amounts of iron nitride to cause the decomposed nitrogen gas to attain a maximum pressure of $4.6\times10^{-2}$ Torr, the curve 8 a barium getter doped with sufficient amounts of $Fe_2Ge$ nitride to cause the decomposed nitrogen gas to present a maximum pressure of $7\times10^{-2}$ Torr and the curve 9 a barium getter doped with sufficient amounts of $Fe_2Ge$ nitride to allow the decomposed nitrogen gas to have a maximum pressure of $4.6\times10^{-2}$ Torr. As seen from FIG. 4, the films (the curves 8 and 9) of barium obtained by applying the getter composition of this invention have a far greater capacity to adsorb gases than that obtained from the known gas doped getter composition.

There will now be described by reference to FIG. 3 the distribution and thickness of a barium film formed in a 17" C.R.T. when there were used a variety of getter compositions according to this invention, all of which contained 70 mg of barium. The abscissa represents those points of the inner walls of a C.R.T. at which there was carried out measurement and the ordinate (or the height of columns) denotes the percent by weight of a deposited film of barium on the basis of the total amount of barium contained in the getter compositions. Numerals 10, 11 and 12 respectively indicate the cases where there were used a non-gas doped barium getter composition, a barium getter composition doped with $Fe_2Ge$ nitride and a barium getter composition doped with $Fe_4N$. Numerals bearing a subscript t given at the bottom of the columns arranged along the abscissa represent the relative thickness of the barium films deposited on the inner walls of the neck portion I, that side II of the cone portion disposed near the neck portion, that side III of the cone portion adjacent to the face portion and the face portion IV. The percent by weight and thickness of barium films formed on the inner walls of the face portion IV or fluorescent screen prove that the getter composition of this invention is more prominently improved than that of the prior art.

As previously described, it is very important to prevent a barium getter from being unnecessarily settled, for example, on the electrodes disposed in the neck portion by being driven backward when there is flashed a getter material in a C.R.T. It has been found that a getter composition according to this invention minimizes the back flashed amounts of a barium getter.

There will now be described the experiments where there were compared the back flashed amounts of a barium getter when there were applied in a 13" C.R.T. a variety of getter compositions all containing 90 mg of barium. The back flash of a barium getter occurred as follows:

| | | |
|---|---|---|
| (a) | non-gas doped barium getter composition | 0.45 mg |
| (b) | getter composition doped with $Fe_4N$ (a maximum nitrogen gas pressure in the tube determined to be $4\times10^{-2}$ Torr) | 2.0 mg |
| (c) | getter composition doped with $Fe_2Ge$ nitride (a maximum nitrogen gas pressure in the tube determined to be $5.6\times10^{-2}$ Torr) | 0.9 mg |
| (d) | getter composition doped with $Fe_2Ge$ (a maximum nitrogen gas pressure in the tube determined to be $7.5\times10^{-2}$ Torr) | 1.8 mg |

The above data prove that the getter composition of this invention wherein the content of $Fe_2Ge$ nitride as a gas dope is so controlled as to provide a proper maximum pressure of nitrogen gas in a C.R.T. can prominently minimize the back flashed amounts of barium. In contrast, a non-gas doped getter composition has the drawback that barium is settled on the fluorescent screen in considerable amounts, though the back flash of said composition as a whole may be reduced due to its mechanical structure.

A colour C.R.T. is demanded to have a particularly high pressure resistance because it contains convergence electrodes, requiring the back flashed amounts of barium to be prominently decreased. As seen from several data previously given, the getter composition of this invention which can reduce the back flashed amounts of barium fully meets the above-mentioned requirements. Photographs of the interior of the neck portion of a C.R.T. further confirm the above-mentioned feature of this invention. These photographs were taken in the manner illustrated in FIG. 5. Both sides of the neck portion 14 of a C.R.T. 13 were shut off from exterior light by a mask 15. Light from a source 16 was scattered by a filter 17 and made to pass through the object portion 18 of the tube where there was disposed a convergence electrode 19. Thus photographs were taken of the interior of said portion 18. Said electrode portion 18 to which there was attached barium was impermeable to light, whereas the other portions of the tube free from the deposition of barium allowed the passage of light, showing how the barium was distributed. This photographing means disclosed that where there was used a getter composition containing the conventional gas dope of iron nitride, that portion 18 of a C.R.T. where there was disposed the convergence electrode 19 was decidely impermeable to light, whereas the getter composition of this invention, when flashed, rendered that portion 18 substantially as light-permeable as when there was flashed the prior art non-gas doped getter composition.

Up to this point, there has been described a getter composition containing a gas dope of $Fe_2Ge$ nitride according to this invention. However, a getter composition including a mixed gas dope of $Fe_2Ge$ nitride and $FeGe_2$ nitride is found to have the same advantageous effect as the previously mentioned type of getter composition. There will now be described the example where there was used said mixed gas dope. First there was prepared an alloy of $FeGe_2$, which was pulverized to powders having an average particle size of less than 35 microns. The powders were nitrogenized in an atmosphere of ammonia. X-ray diffraction analysis shows that the nitride thus obtained mainly consisted of $\beta$-$Ge_3N_4$ with minor amounts of $Fe_4GeN$. Thereafter there was prepared $Fe_2Ge$ nitride in the same manner as previously described. A mixed gas dope mainly consisting of $Fe_2Ge$ nitride with a proper amount of $FeGe_2$ nitride was charged into a conductive vessel 5 together with a getter material of barium-aluminium alloy including powders of nickel, obtaining a desired getter composition. With a C.R.T. using this getter composition, it was experimentally confirmed that the fluorescent screen was contaminated with far less amounts of barium than when there was used a getter composition containing a single gas dope used on the preceding example.

It has been further disclosed that when the content of a gas dope according to this invention in a getter composition is so chosen as to cause a nitrogen gas in the tube to present a pressure of 5 to $8\times10^{-2}$ Torr (a maximum pressure attained by the decomposition of said gas dope), then the deposition of barium particularly on the fluorescent screen could be prominently reduced.

What is claimed is:

1. A nitrogen-emitting composition which is useful together with flash getter materials comprising a mixture consisting essentially of a major portion of $Fe_4GeN$ and a minor portion of $\beta$-$Ge_3N_4$, which emits nitrogen when heated.

* * * * *